US007891863B2

(12) United States Patent
Schäfer

(10) Patent No.: US 7,891,863 B2
(45) Date of Patent: Feb. 22, 2011

(54) CORRECTING DEVICE FOR A TIMEPIECE

(75) Inventor: Georg Schäfer, Le Brassus (CH)

(73) Assignee: Blancpain S.A., Le Brassus (CH)

( * ) Notice: Subject to any disclaimer, the term of this patent is extended or adjusted under 35 U.S.C. 154(b) by 53 days.

(21) Appl. No.: 10/599,278

(22) PCT Filed: Mar. 9, 2005

(86) PCT No.: PCT/EP2005/002493

§ 371 (c)(1),
(2), (4) Date: Jul. 9, 2008

(87) PCT Pub. No.: WO2005/103844

PCT Pub. Date: Nov. 3, 2005

(65) Prior Publication Data

US 2008/0259740 A1 Oct. 23, 2008

(30) Foreign Application Priority Data

Mar. 24, 2004 (EP) ..... 04007043

(51) Int. Cl.
*G04B 18/00* (2006.01)

(52) U.S. Cl. ..... 368/185

(58) Field of Classification Search ..... 368/146, 368/216, 306, 308, 190, 319, 222, 185, 290, 368/155; 310/156.01, 41, 40 MM
See application file for complete search history.

(56) References Cited

U.S. PATENT DOCUMENTS 3,762,159 A * 10/1973 Kitai et al. ..... 368/97
3,780,525 A * 12/1973 Kitai ..... 368/222
4,126,796 A * 11/1978 Ito ..... 310/40 MM
5,751,668 A * 5/1998 Eray ..... 368/290
6,315,443 B1 * 11/2001 Meyrat et al. ..... 368/290
7,293,911 B2 * 11/2007 Bonvin et al. ..... 368/97
2001/0046187 A1 * 11/2001 Graemiger ..... 368/190

FOREIGN PATENT DOCUMENTS

CH 344966 2/1960
GB 1120020 7/1968

OTHER PUBLICATIONS

International Search Report issued in corresponding application No. PCT/EP2005/002493, completed Jun. 29, 2005 and mailed Jul. 5, 2005.
Webster's New Collegiate Dictionary 720 (1977), which is filed herewith as "Exhibit A".
Illustrated Professional Dictionary of Horology I+II 909 (2002), which is filed herewith as "Exhibit B".

* cited by examiner

*Primary Examiner*—Edwin A. Leon
(74) *Attorney, Agent, or Firm*—Griffin & Szipl, P.C.

(57) ABSTRACT

The invention concerns a corrector device for a timepiece for correcting a piece of information provided by an indicator mechanism (46), the timepiece comprising a case (1) delimiting a volume (8), the device being characterised in that it includes a control lever (14) located outside the volume (8) of the case (1) and able to be actuated by a user, and an actuating lever (16) located inside the volume (8) of the case (1) and cooperating with the indicator mechanism (46) providing the information to be corrected, the control lever (14) and the actuating lever (16) being connected to each other by a stem (20).

13 Claims, 3 Drawing Sheets

CORRECTING DEVICE FOR A TIMEPIECE

This is a National Phase Application in the United States of International Patent Application No. PCT/EP2005/002493 filed Mar. 9, 2005, which claims priority on European Patent Application No. 04007043.5, filed Mar. 24, 2004. The entire disclosures of the above patent applications are hereby incorporated by reference.

FIELD OF THE INVENTION

The present invention concerns a corrector device for a timepiece such as a wristwatch for correcting a piece of information provided by an indicator mechanism.

BACKGROUND OF THE INVENTION

Some watches, in particular watches with complications, comprise such a large number of functions that it is not possible to correct them all by means of a single crown. This is why additional control means are used such as push-buttons. Among such push-buttons, there are known miniature push-buttons essentially comprising a socket driven into or bonded in an aperture made in the middle part of the watch and a cylindrical shaft formed of a single piece and able to slide freely into the socket. The shaft includes a first part passing through an aperture arranged at the inner end of the socket, and a second part of larger diameter than the diameter of the first part and comprising a groove for housing a sealing gasket cooperating with the inner wall of said socket. A push-button of this type comprises a return spring in the form of a spiral. The correction operations are performed by pushing the stem into the socket by means of a sharp instrument such as a ballpoint pen for example. During its movement forward, the push-button stem abuts against a lever via which the correction is carried out. Pushing in the stem compresses the spring. If the pressure on the stem is released, the latter returns to its rest position via the effect of the return force of the spring.

Push-buttons of the type described hereinbefore have very reduced dimensions. Such push-buttons thus save space. Moreover, they do not project from the middle part and thus are not liable to be accidentally activated. However, they have the drawback of being unattractive and requiring the use of a tool in order to be actuated.

It is thus an object of the present invention to overcome the aforementioned drawbacks in addition to others by providing a corrector device for a timepiece for correcting a piece of information which constitutes an alternative to the miniature push-buttons of the prior art.

SUMMARY OF THE INVENTION

The present invention thus concerns a corrector device for a timepiece for correcting a piece of information provided by an indicator mechanism, the timepiece comprising a case delimiting a volume, the device being characterised in that it includes a control lever located outside the volume of the case and able to be actuated by a user, and an actuating lever located inside the volume of the case and cooperating with the indicator mechanism whose information needs to be corrected, the control lever and the actuating lever being connected to each other by a rotating connecting member able to rotate about a general axis of symmetry.

Owing to these features, the present invention provides a corrector device, which can be actuated very simply by the person wearing the watch by means of a finger or a nail. No tools are necessary for such an operation. The aesthetic appearance of the watch is also substantially improved insofar as the control lever can be given any appropriate shape which can match the general external forms of the watchcase.

According to a complementary feature of the invention, the control and actuating levers are rigidly connected to each other by means of a stem.

The constituent means of the corrector device according to the invention are of simple construction, which saves on manufacturing costs and guarantees the reliable operation of such a device.

BRIEF DESCRIPTION OF THE DRAWINGS

Other features and advantages of the present invention will appear more clearly from the following detailed description of an example embodiment of the corrector device according to the invention, this example being given purely by way of illustrative and non-limiting example, in conjunction with the annexed drawing, in which.

DETAILED DESCRIPTION OF THE INVENTION

The present invention proceeds from the general inventive idea that consists in providing a corrector device for correcting a piece of information provided by an indicator mechanism, particularly of a multi-function watch, which is easy to handle, which is not detrimental to the aesthetic appearance of the watch and which is of simple construction.

Figure 1:
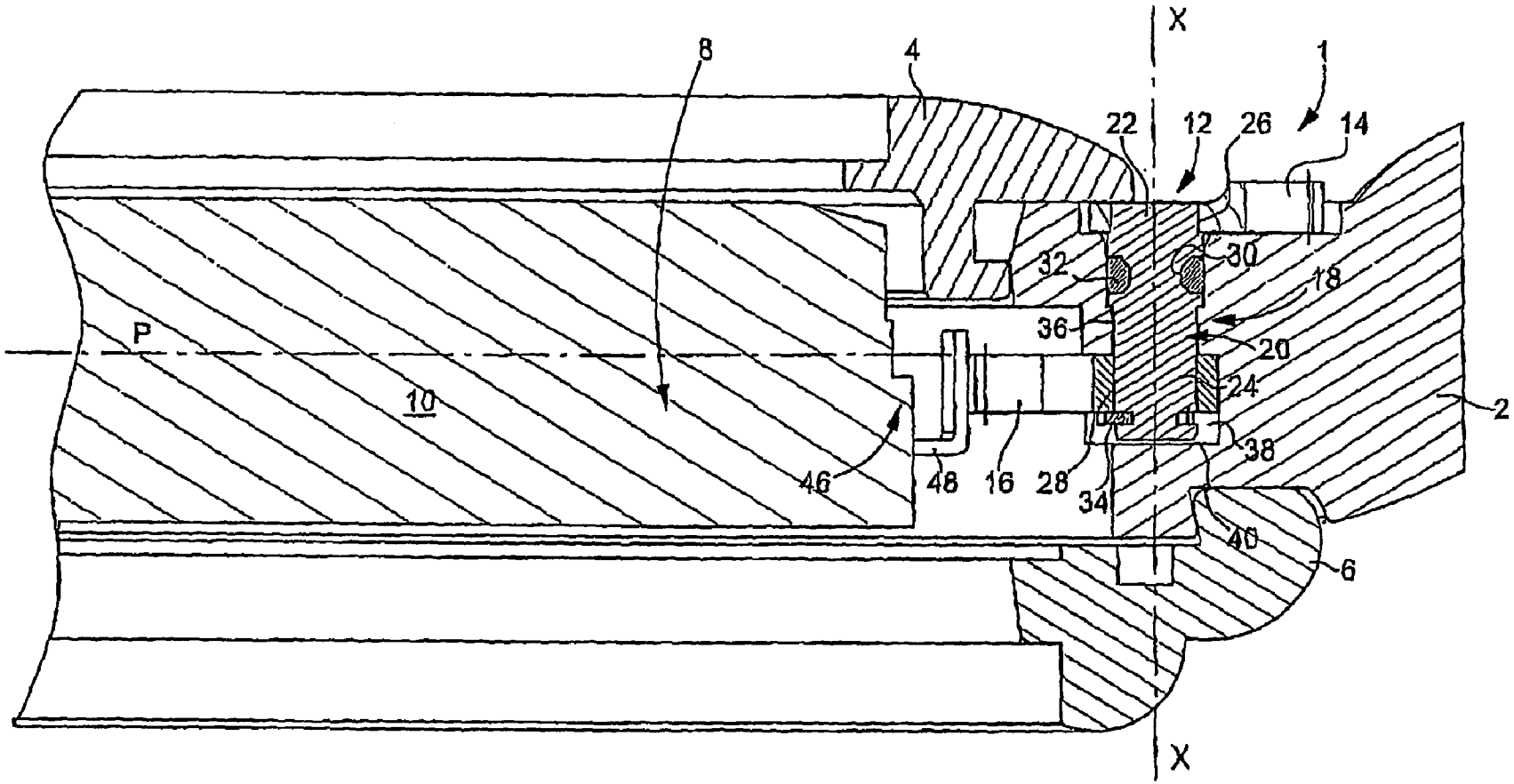
FIG. 1 is a cross-section of a watchcase provided with the corrector device according to the invention, this cross-section passing through one of the horns of the case, which enables a wristband to be attached.

FIG. 1 is a cross-section of a watchcase along an axis parallel to the 12 o'clock-6 o'clock axis. Designated as a whole by the general reference numeral 1, this watchcase essentially includes a middle part 2 on which a bezel 4 and a back cover 6 are fixed. According to a variant, the watch could be of the mono-shell type, i.e. the middle part 2/bezel 4 or middle part 2/back cover 6 assembly could be made in one piece. Thus formed, this watchcase 1 delimits an internal volume 8 in which there is housed, in particular, a movement 10 which extends in a mid-plane P substantially parallel to the plane defined by back cover 6. This movement can be purely mechanical or of the electromechanical type powered by an electrical energy source (not shown). The watch could also be of the purely digital type with, for example, a liquid crystal display device and include an additional indicator mechanism as described hereinafter providing information that can be corrected by means of the corrector device according to the invention.

Figure 2:
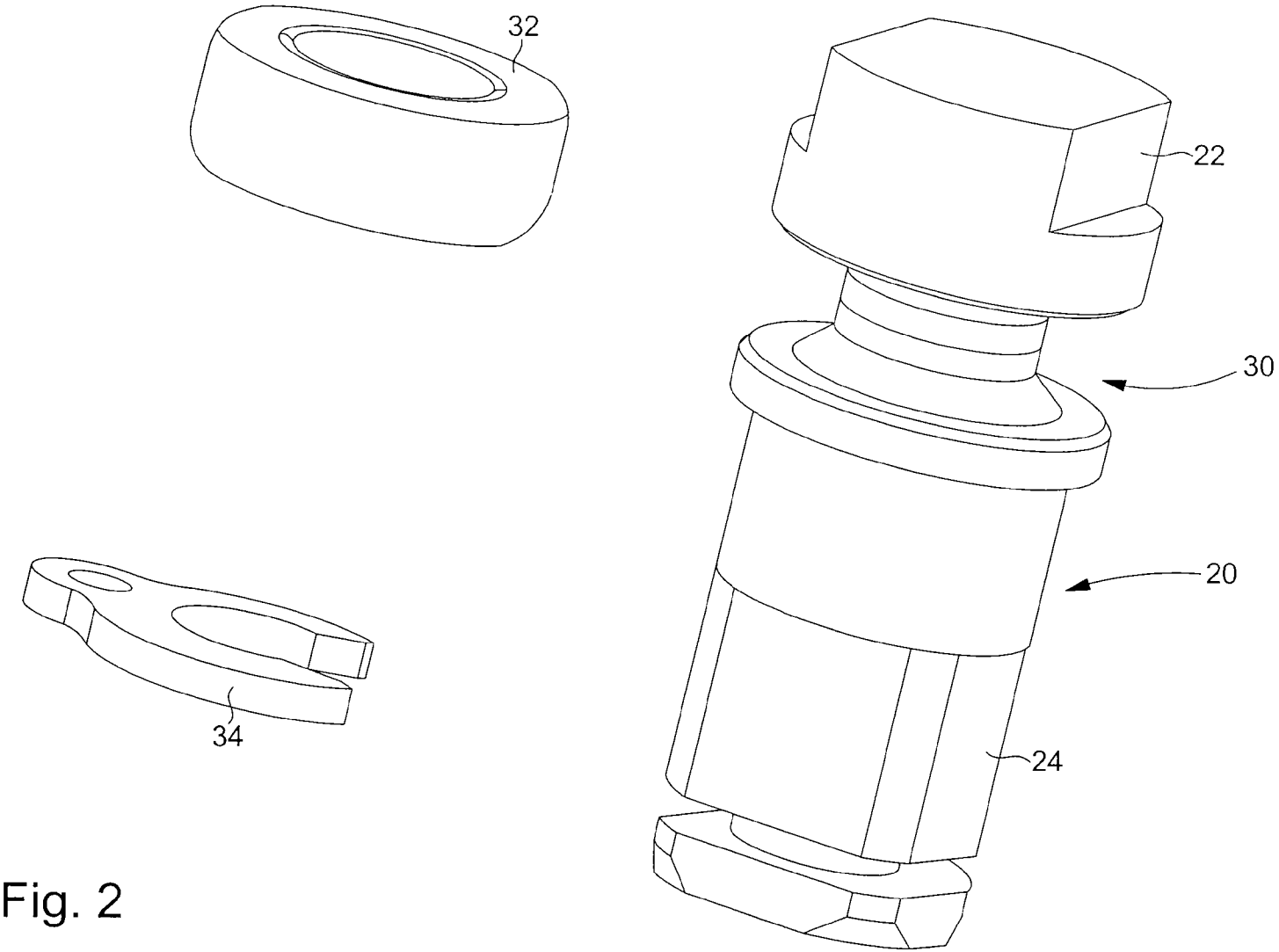
FIG. 2 is a perspective view of the stem connecting the control lever to the actuating lever.

Designated as a whole by the general reference numeral 12, said corrector device according to the invention includes a control lever 14 and an actuating lever 16, which extend in two parallel and distinct planes and are connected to each other by a rotating connecting member 18 able to rotate about a general axis of symmetry X-X. In the embodiment shown in FIGS. 1 and 2, connecting member 18 takes the form of a stem 20 inscribed in the envelope of a cylinder and at the two ends of which are rigidly secured control lever 14 located outside volume 8 of case 1 and actuating lever 16 located inside said case 1.

Cylindrical stem 20 is advantageously made in a single piece. Two male squares 22 and 24 are machined on stem 20, engaged in two square female holes 26 and 28 provided in control lever 14 and actuating lever 16 such that said two levers 14 and 16 are immobilised in rotation relative to said stem 20. Cylindrical stem 20 also has a groove 30 housing a sealing gasket 32. Towards its lower end, stem 20 also has a reduced diameter for mounting an elastic ring 34, which is used for the axial immobilisation of actuating lever 16.

Corrector device 12 according to the invention is mounted in the following manner. Stem 20 provided with its sealing gasket 32 is introduced into a through hole 36 arranged in middle part 2 of the watch. This through hole 36 communicates with a cavity 38, which opens out inside volume 8 delimited by middle part 2 and whose shape and dimensions are adapted to receive actuating lever 16. Once actuating lever 16 has been introduced into cavity 38 via its end with female square hole 28, stem 20 is lowered into through hole 36. Male square 24 of stem 20 penetrates female square hole 28 of actuating lever 16, such that the latter is secured to said stem 20 in rotation. The downward movement of stem 20 is interrupted when the latter abuts against bottom 40 of cavity 38. At that moment, elastic ring 34 can be engaged on stem 20 so as to immobilise actuating lever 16 axially relative to said stem 20. The next operation consists in mounting control lever 14 on stem 20 by engaging the male square of said stem 20 at its upper end in female square hole 26 of said control lever 14. Lever 14 is thus immobilised in rotation relative to stem 20. According to a first variant, lever 14 and stem 20 are made in one piece. According to a second variant, said lever 14 is welded onto said stem 20.

Figure 3:
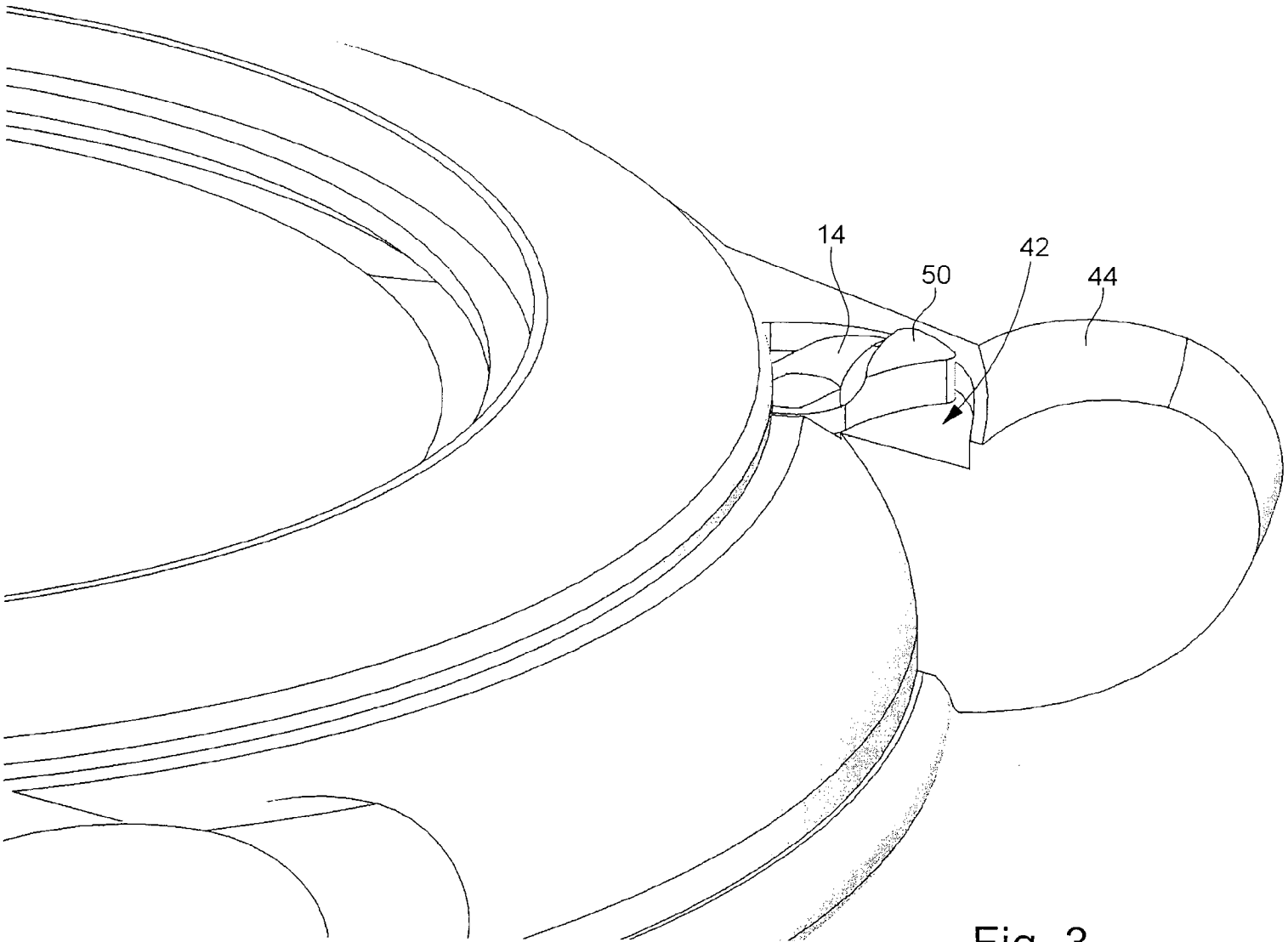
FIG. 3 is a perspective view of the watchcase in which it can be seen that the control lever is embedded in a hollow made in the thickness of one horn of the case.

It will be observed that, according to a preferred but non-limiting embodiment of the invention illustrated in FIG. 3, control lever 14 is embedded in a hollow 42 arranged in the lower surface of one of horns 44 of case 1. Control lever 14 thus does not project from the surface of watchcase 1, which improves the aesthetic appearance of the latter and prevents said lever 14 from being inadvertently activated by remaining, for example, caught on the sleeve of a piece of clothing.

The general axis of symmetry X-X of corrector device 12 according to the invention extends, in the examples shown in the drawing, substantially perpendicularly to the plane P of movement 10. Of course, according to a variant corrector device 12 could also extend parallel to the plane of the movement while being engaged radially in the middle part.

Corrector device 12 is intended to allow a user to correct an indication given by an indicator mechanism 46. The information to be corrected may be related to the time. It may be, for example, the day of the week or the phases of the moon. However. The information may also be completely unrelated to the time. In such case, indicator mechanism 46 may be, for example, a counter that is incremented to record the score of a round of golf. Thus, actuating lever 16 cooperates with a corrector lever 48, which is itself meshed, directly or indirectly, with indicator mechanism 46 that provides information that has to be corrected. In order to do this, the user has only to make control lever 14 pivot with his finger. This pivoting movement is transmitted by stem 20 to actuating lever 16, which in turn drives corrector lever 48. Advantageously, corrector lever 48 can exert an elastic return force on corrector device 12 to return control lever 14 to its rest position.

As can be seen upon examining FIG. 3, the control lever can be provided with a snug 50 to facilitate handling thereof.

It goes without saying that the present invention is not limited to the embodiment that has just been described and that various modifications and simple variants can be envisaged by those skilled in the art without departing from the scope of the present invention as defined by the annexed claims.

The invention claimed is:

1. A control device for a timepiece for activating a first mechanism, wherein the timepiece comprises a case delimiting a volume, wherein the control device includes:

a control lever located outside the volume of the case and able to be actuated by a user; and an actuating lever located inside the volume of the case and meshed, directly or indirectly, with the first mechanism, wherein the control lever and the actuating lever are connected to each other via a rotating connecting mechanism able to rotate about a general axis of symmetry, wherein the control lever and the actuating lever extend in two parallel and distinct planes.

2. The control device according to claim 1, wherein the control lever is embedded in a hollow arranged in a horn of the case.

3. The control device according to claim 1, wherein the general axis of symmetry extends perpendicularly or parallel to a mid-plane in which there extends a movement of a timepiece.

4. The control device according to claim 1, wherein the actuating lever is meshed, directly or indirectly, with the first mechanism so as to correct information provided by the first mechanism.

5. The control device mechanism according to claim 1, wherein the control lever and the actuating lever are rigidly connected to each other by means of a stem.

6. The control device according to claim 5, wherein the stem has a groove that houses a sealing gasket.

7. The control device according to claim 1, wherein the actuating lever cooperates with a corrector lever that is meshed with the first mechanism, and the first mechanism is an indicator mechanism.

8. The control device according to claim 7, wherein the corrector lever exerts an elastic return force on the actuating lever.

9. A control device for a timepiece for activating a first mechanism, wherein the timepiece comprises a case delimiting a volume, wherein the control device includes:

a control lever located outside the volume of the case and able to be actuated by a user; and an actuating lever located inside the volume of the case and cooperating with the first mechanism, wherein the control lever and the actuating lever are connected to each other via a rotating connecting mechanism able to rotate about a general axis of symmetry, wherein the control lever and the actuating lever extend in two distinct planes, wherein the control lever and the actuating lever are rigidly connected to each other by means of a stem, and wherein the stem is provided with two male squares that are engaged in two square female holes provided in the control lever and the actuating lever.

10. The control device according to claim 9, wherein the actuating lever is immobilized axially on the stem by an elastic ring.

11. A control device for a timepiece for activating a first mechanism, wherein the timepiece comprises a case delimiting a volume, wherein the control device includes:

a control lever located outside the volume of the case and able to be actuated by a user; and an actuating lever located inside the volume of the case and meshed, directly or indirectly, with the first mechanism, wherein the control lever and the actuating lever are connected to each other via a rotating connecting mechanism able to rotate about a general axis of symmetry, wherein the control lever and the actuating lever extend in two parallel and distinct planes, wherein the actuating lever cooperates with a corrector lever that is meshed with the first mechanism, and the first mechanism is an indicator mechanism, and wherein the general axis of symmetry extends perpendicularly or parallel to a mid-plane in which there extends a movement of a timepiece.

12. The control device according to claim 11, wherein the control lever is embedded in a hollow arranged in a horn of the case.

13. The control device according to claim 11, wherein the actuating lever is meshed, directly or indirectly, with the first mechanism so as to correct information provided by the first mechanism.

* * * * *